United States Patent [19]

Kruger et al.

[11] Patent Number: 5,065,826

[45] **Date of Patent: * Nov. 19, 1991**

[54] APPARATUS FOR OPTIONAL STRAIGHT OR DIRECTIONAL DRILLING UNDERGROUND FORMATIONS

[75] Inventors: Volker Kruger, Celle; Rolf Panzke, Blenhorst, both of Fed. Rep. of Germany

[73] Assignee: Baker Hughes Incorporated, Houston, Tex.

[ * ] Notice: The portion of the term of this patent subsequent to Apr. 26, 2005 has been disclaimed.

[21] Appl. No.: 418,970

[22] Filed: Oct. 10, 1989

Related U.S. Application Data

[63] Continuation of Ser. No. 281,975, Nov. 30, 1988, abandoned, which is a continuation of Ser. No. 145,055, Jan. 19, 1988, abandoned, which is a continuation of Ser. No. 910,286, Sep. 17, 1986, Pat. No. 4,739,842 which is a continuation of Ser. No. 731,181, May 6, 1985, abandoned.

[30] Foreign Application Priority Data

| | | | |
|---|---|---|---|
| May 12, 1984 | [DE] | Fed. Rep. of Germany | 3417743 |
| May 12, 1984 | [DE] | Fed. Rep. of Germany | 8414613 |
| Jun. 26, 1984 | [DE] | Fed. Rep. of Germany | 3423465 |

[51] Int. Cl.[5] ..... E21B 7/06; E21B 4/02

[52] U.S. Cl. ..... 175/75; 175/76; 175/92; 175/107

[58] Field of Search ..... 175/73–76, 175/61, 325, 107, 106, 101, 92

[56] References Cited

U.S. PATENT DOCUMENTS

| | | | |
|---|---|---|---|
| 3,260,318 | 7/1966 | Neilson et al. | 175/75 |
| 3,561,549 | 2/1971 | Garrison et al. | 175/76 |
| 3,586,116 | 6/1971 | Tiraspolsky et al. | 175/74 |
| 3,945,446 | 3/1976 | Ostertag et al. | 175/325 |
| 4,067,404 | 1/1978 | Crase | 175/75 |
| 4,227,584 | 10/1980 | Driver | 175/61 X |
| 4,245,709 | 1/1981 | Manuel | 175/325 |
| 4,319,649 | 3/1982 | Jeter | 175/73 |
| 4,445,578 | 5/1984 | Millheim | 175/61 |
| 4,465,147 | 8/1984 | Feenstra et al. | 175/73 |
| 4,492,276 | 1/1985 | Kamp | 175/61 |
| 4,501,336 | 2/1985 | Kemp et al. | 175/76 |
| 4,522,272 | 6/1985 | Beimgraben | 175/74 |
| 4,610,307 | 9/1986 | Jurgens et al. | 175/325 X |
| 4,739,842 | 4/1988 | Kruger et al. | 175/61 |

FOREIGN PATENT DOCUMENTS

| | | | |
|---|---|---|---|
| 85444 | 10/1983 | European Pat. Off. . | |
| 1593999 | 7/1970 | France | 175/73 |
| 2369412 | 2/1978 | France | 175/61 |
| 2544375 | 10/1984 | France | 175/61 |
| 473793 | 9/1975 | U.S.S.R. | 175/75 |
| 947375 | 7/1982 | U.S.S.R. | 175/74 |

*Primary Examiner*—Hoang C. Dang

*Attorney, Agent, or Firm*—Trask, Britt & Rossa

[57] ABSTRACT

A device for selective straight or directional drilling in subterranean rock formations consists of a rotary drilling tool having a tool main axis and comprising a housing which comprises several sections and can be connected to a drill string, the housing having a downhole motor for driving a drill bit via a driven shaft. For straight drilling, the housing can be set in independent, slow rotation about the tool main axis by being turned by the drill string, and for directional drilling can be aligned and fixed against turning. The lower section of the housing adjacent to the drill bit and mounting the driven shaft is deflected relative to the tool main axis, and this section is connected to an upper section by an intermediate section which has an axis which intersects the axes of the upper and lower section. The device may include a plurality of interchangeable intermediate sections.

2 Claims, 9 Drawing Sheets

Fig. 6
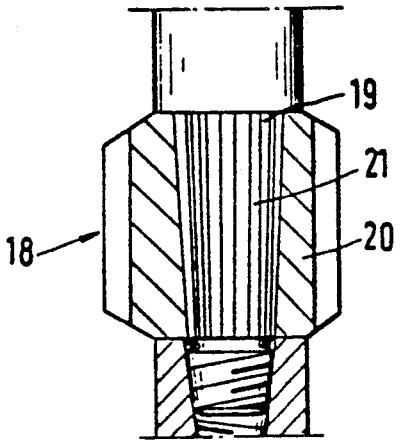
Fig. 7
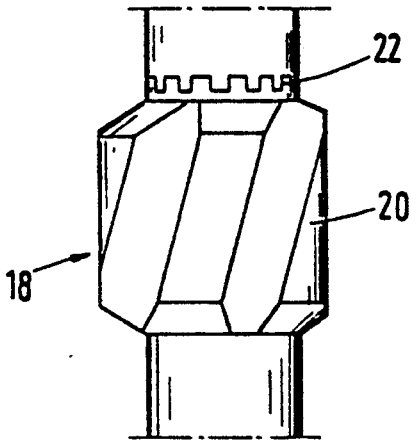
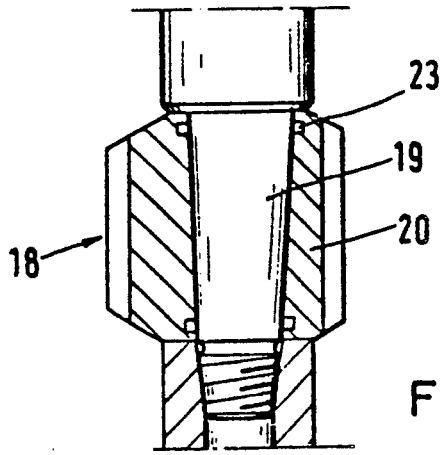
Fig. 8

Fig. 9
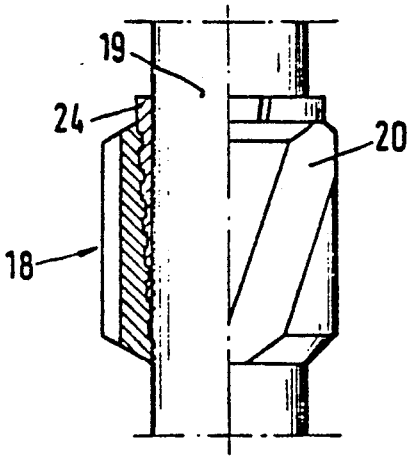
Fig. 10
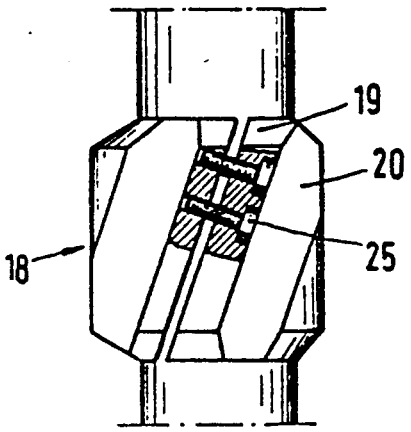
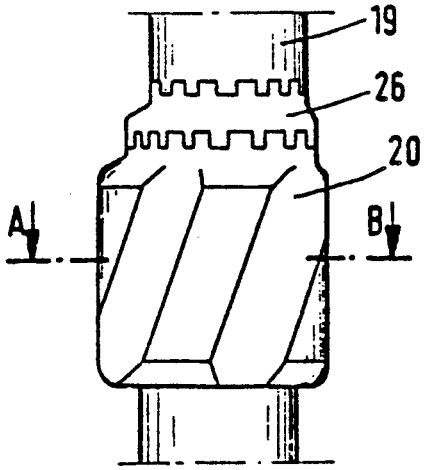
Fig. 11
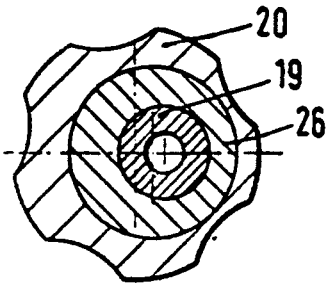
( A-B )
Fig. 12

APPARATUS FOR OPTIONAL STRAIGHT OR DIRECTIONAL DRILLING UNDERGROUND FORMATIONS

This application is a continuation of application Ser. No. 281,975, filed Nov. 30, 1988, now abandoned, which is a continuation of Ser. No. 145,055 filed Jan. 19, 1988, now abandoned, which is a continuation of Ser. No. 910,286 filed Sept. 17, 1986, now U.S. Pat. No. 4,739,842, which is a continuation of Ser. No. 731,181 filed May 6, 1985, now abandoned.

TECHNICAL FIELD

This invention relates to apparatus for selective straight or directional drilling underground formations.

BACKGROUND ART

European Patent Application No. 0085444 describes a device which is capable of being used for straight drilling or for drilling at an angle. In particular the application describes a method and means for controlling the course of a bore hole during drilling.

The method and means includes first and second stabilisers which are arranged to support the housing for a down-hole motor having an output shaft for connecting to a drill bit. At least one of the stabilisers is eccentric relative to the housing so that rotation of the housing will cause a change in the angle of the axis of the output shaft of the down-hole motor. Thus by controlling the rotation of the housing and the length of time of operation of the down-hole motor the course of the borehole can be controlled.

The change in angle causes stresses to be introduced into the housing which are transmitted to the drill bit causing excessive friction between the drill bit and the wall of the bore-hole. Furthermore additional strains are imposed on the stabilisers, the connections between the drill string and the housing, between the down-hole motor output shaft and the drill bit and between sections of the housing. These stresses can lead to damage and/or excessive wear of bearings.

It is an object of the present invention to provide an improved device for use in underground drilling which reduces the stress-related problems identified above.

SUMMARY OF THE INVENTION

According to the present invention we provide a device for use in underground drilling of bore-holes comprising:

a tubular housing;

a down-hole motor mounted in said housing and having an output shaft;

means for connecting said output shaft to a drill bit;

means for connecting said housing to a drill string;

first and second stabilisers mounted on said housing;

said housing comprising an upper section, an intermediate section and a lower section connected to one another, said first stabiliser being associated with said lower section of said housing and said second stabiliser being associated with said upper section of said housing;

said upper section having a longitudinal axis and said lower section having a longitudinal axis which is arranged at an angle relative to the axis of said upper section; and said intermediate section having a longitudinal axis which intersects said upper and lower section axes.

Preferably the upper and lower sections of the housing are connected to the intermediate section by angled connectors, especially threaded connectors.

In one form of the invention said intermediate section includes a plurality of interchangeable elements whereby the angle between the axes of the upper and lower housing sections can be preset. Conveniently the length of the intermediate section when preset at one angle is different from the length of the intermediate section when set at a different angle.

In this form of the invention it is preferred that the lower housing section is provided with a connecting portion which is set at an angle relative to the lower section axis which is determined by the preset angle to the intermediate section.

The position of the first and/or second stabilisers can be adjustable relative to the lower housing section and/or upper housing section respectively.

It is preferred that at least the first stabiliser had adjustable eccentricity. Suitable stabilisers having adjustable eccentricity are described in German Patent Application No. P34 03 239.8-24.

BRIEF DESCRIPTION OF THE DRAWINGS

Reference is now made to the accompanying drawings, in which:

FIGS. 6 to 10 illustrate diagrammatically alternative embodiments of eccentric stabilisers for use in the device of the invention;

FIG. 11 is a side view of a stabiliser with adjustable eccentricity;

FIG. 12 is a cross-section through the stabiliser shown in FIG. 11;

DESCRIPTION OF THE PREFERRED EMBODIMENTS

Figure 1:
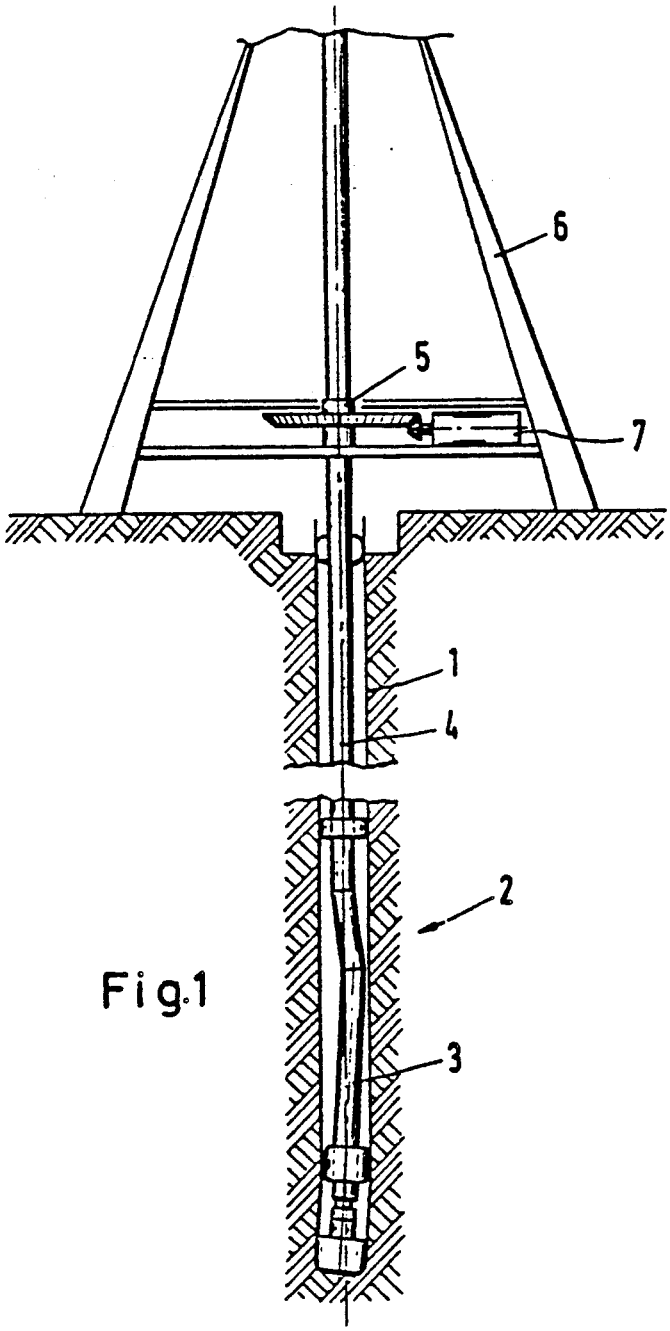
FIG. 1 is a schematic diagram of a drilling device for use in controlled drilling of a bore-hole according to the invention.

The device shown in FIG. 1 incorporates the concepts of European Patent Application No. 0085444 the disclosure of which is included herein by reference. The drilling device 2 is shown in position in a bore-hole 1. It comprises a housing 3 connected to a drill string 4 by means not shown. The connecting means may be a screw threaded arrangement as shown in European Patent Application No. 0085444. The drill string 4 is arranged to be rotated by a turntable 5 having a locking device 7 to prevent rotation of the turntable 5 and drill string 4. The turntable 5 and locking device 7 are mounted on a derrick 6.

The locking device 7 controls the rotation of the drill string 4 to permit, for example continuous rotation or limited rotation for alignment purposes. When the locking device is in its locking condition it prevents rotation of the drill string 4 and the housing 3.

Figure 2:
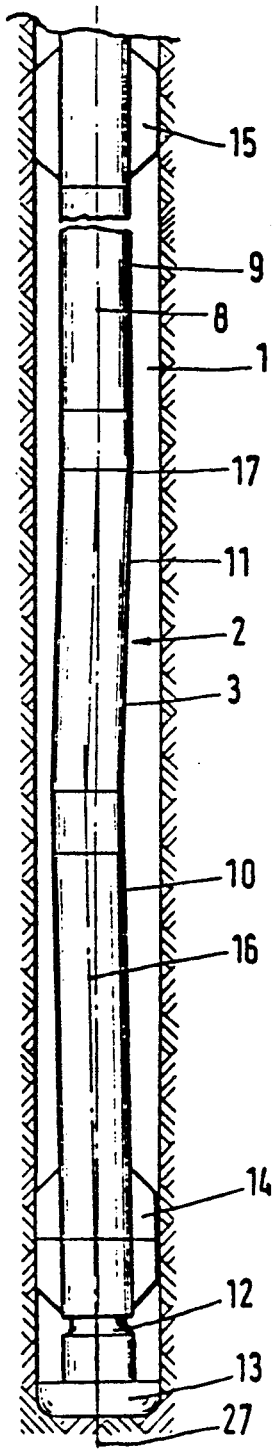
FIGS. 2 and 3 are schematic diagrams of alternative drilling devices according to the invention.
Figure 3:
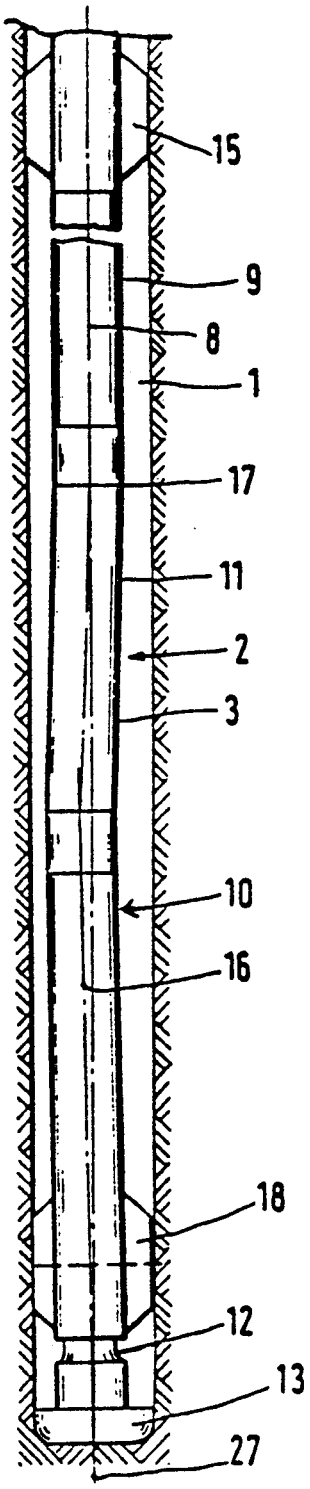

The alternative embodiments of the drilling device 2, shown in FIGS. 2 and 3, have, as common features, a housing 3 which consists of an upper section 9 concentric with a tool main axis 8, a lower section 10 deflected relative to the tool main axis 8, and an intermediate section 11 connecting the lower section 10 to the upper section 9.

A motor (not shown) may be arranged in the section 9 of the housing 3. The motor may be of any conventional type, for example, a turbine motor, a vane motor, a Moineau type motor or an electric motor. The motor rotor is connected to a rotary drill bit 13 via a universal joint and shaft leading through the intermediate section 11 and via a driven shaft 12 mounted in the lower housing section 10.

A stabiliser 14 is located on the lower section 10 and a stabiliser 15 is located on the upper section 9 or slightly above it. The lower stabiliser 14 ensures that the axis 16 of the lower section 10, which determines the rotational axis of the driven shaft 12 and the rotary drill bit 13, intersects with the main axis 8 near to the rotary drill bit 13. The point of the intersection, in the embodiment of FIG. 2, is exactly at the centre of gravity of the stabiliser 14.

Figure 4:
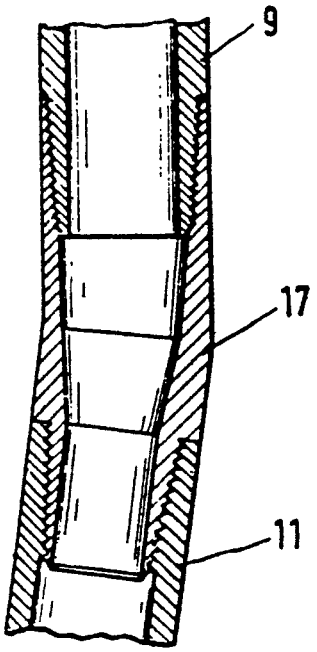
FIGS. 4 and 5 are detailed views on an enlarged scale of parts of the device shown in FIG. 2.
Figure 5:
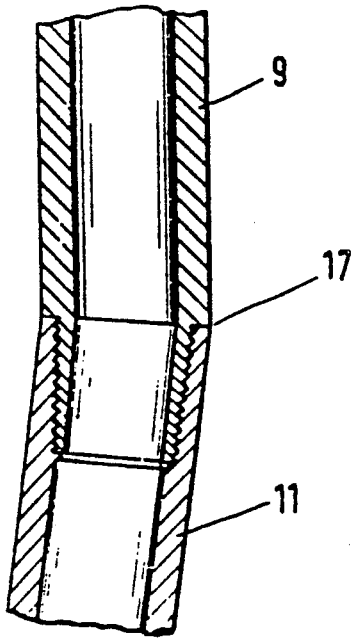

The upper stabiliser 15 ensures that the angle of deflection of the lower section 10 is maintained relative to the main axis 8, which angle is preset by the manner in which sections 10, 11 and 9 are joined together. This joining can be effected to provide a transition 17 by short pipe bends, as shown in detail in FIG. 4, between the upper section 9 and the intermediate section 11, or by inclined, threaded connections fixed directly onto sections 9, 11, as shown in FIG. 5.

By deflecting the axis of the lower housing section 10 and thus axes of the drive shaft 12 and the rotary drill bit 13 relative to the main tool axis 8, with the housing 3 in a fixed positon, the bore-hole 1 produced has a bent profile pointing in the direction of the axis 16. If the housing 3 is also turned, the bent rotation axis 16 also rotates, so that the resulting movement of the rotary drill bit 13 will provide a bore-hole 1 having a profile in the direction of the tool main axis 8. Selective directional drilling or straight drilling can thus be achieved in a simple manner by locking or turning the rotary table 5 and hence the drill string 4 and housing 3.

By arranging the point of intersection of the rotational axis 16 with the tool main axis 8 to be near to the rotary drill bit 13 the bore-hole widens only slightly when operating in the straight drilling mode and compared with the directional drilling operation mode because of the eccentric movement of the rotary drill bit 13.

The amount of bore-hole widening corresponds to about twice the value of the axial displacement 27 between the rotational axis 16 and the main tool axis 8 in the area of the rotary drill bit 13; this axial displacement 27 is also referred to as offset.

The offset 27 can be reduced to zero if an eccentric stabiliser is used instead of the centric stabiliser 14 shown in FIG. 2; the eccentricity of the eccentric stabiliser is arranged to compensate for the offset. FIG. 3 shows such a modified embodiment in which the stabiliser 18 adjacent to the rotary drill bit 13 is an eccentric stabiliser. Such an embodiment can be used to avoid widening of the bore-hole during straight drilling and also has the advantages that wear in the gauge area of the rotary drill bit 13 and on the outer surface of the stabiliser 18 can be reduced and that bending stresses can be kept away from the housing 3.

The drilling tool 2 can be operated with drill bits 13 of various diameter. This is facilitated by providing interchangeable stabilisers. The eccentricity of the lower stabiliser 18 can be preset. FIGS. 6 to 12 illustrate various embodiments of eccentric stabiliser.

The stabiliser 18 shown in FIGS. 6 and 7 consists in each case of a carrier body 19 and a ribbed shell 20 which is fixed on the a carrier body 19 and a ribbed shell 20 which is fixed on the carrier body 19 by a positive connection. In the alternatives shown, the ribbed shell 20 can be aligned stepwise relative to the carrier body 19. In the embodiment in FIG. 6, the positive connections between parts 19 and 20 are formed by splines 21 and in the embodiment in FIG. 7 by radially distributed teeth 22.

The alternatives shown in FIGS. 8 to 10 enable the ribbed shell 20 to be interchanged and provide for continuous adjustment relative to the carrier body 19. The relative positions of the shell and carrier body can be fixed by a frictional connection.

In FIG. 8, the ribbed shell 20 is fixed by an interference fit which is brought about by applying hydraulic pressure to expand the ribbed shell 20 forcing it onto the carrier body and relieving the pressure load on the ribbed shell 20. The shell 20 is provided with seals 23.

FIG. 9 shows how the ribbed shell 20 can be fixed by means of a longitudinally slotted intermediate shell 24 which presents a conical threaded area to the ribbed shell 20 and, when screwed together with the shell 19 locks it to the carrier body 19. In the alternative shown in FIG. 10 the ribbed shell 20 is slotted along a rib and is clamped to the carrier body 19 in the manner of a clamping collar by several screws 25.

If the stabiliser 18 is desired to have selected preset eccentricity an embodiment such as shown in FIGS. 11 and 12 can be selected. In addition to the carrier body 19 and the ribbed shell 20, the stabiliser comprises an eccentric intermediate shell 26. By turning the ribbed shell 20 relative to the intermediate shell 26, the amount of eccentricity of the stabiliser 18 can be changed stepwise between a maximum value and a minimum value, retaining the possibility of alignment of the ribbed shell 20 relative to the carrier body 19. The parts are fixed by radially distributed teeth, as described with respect to the embodiment of FIG. 7.

Figure 13:
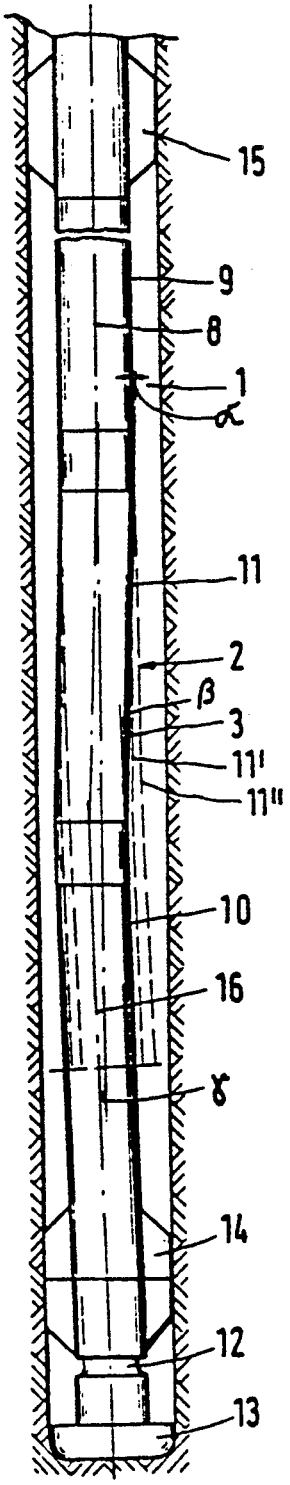
FIG. 13 is a schematic diagram of a further device according to the invention.
Figure 14:
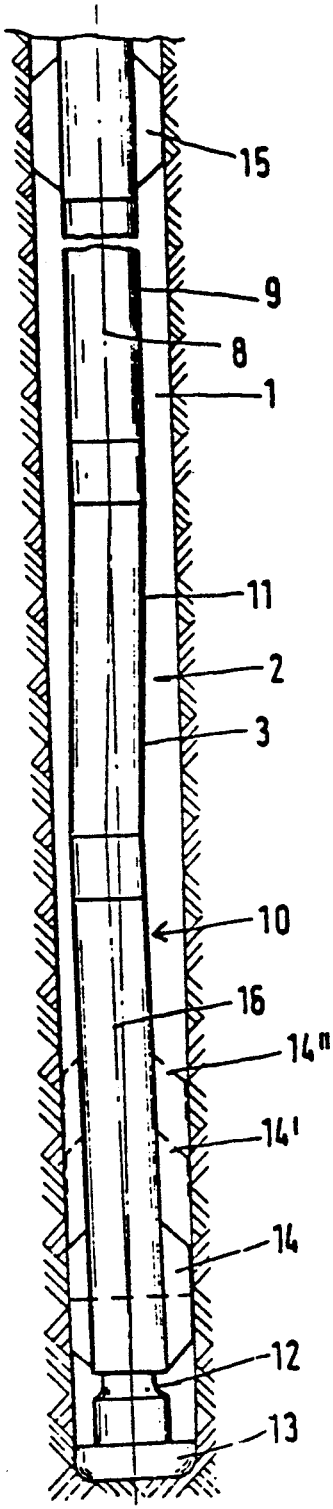
FIG. 14 is a schematic diagram of a device according to the invention with a lower stabiliser shown in different positions.

In the embodiments of the drilling tool 2 shown in FIGS. 13 and 14 the intermediate section 11 is designed as a plurality of interchangeable elements so that the angle between the axes of the upper and lower sections can be preset. The embodiments are modifications of the embodiment shown in FIG. 2 and similar reference numerals are used for similar components.

When straight drilling, to minimise the disturbing effects caused by the deflected section 10 of the drilling tool 2, the deflection tendency of the drilling tool is determined so that exactly the required minimum radius of curvature can be achieved during directional drilling. The deflection tendency can be obtained by presetting a corresponding deflection angle $\alpha$ of the intermediate section 11. This is illustrated in FIG. 13 by two further angles represented by dotted lines 11' and 11'', with 11'' corresponding to a deflection of 0°, which is equivalent to the intermediate section 11'' being aligned coaxially with the tool main axis 8.

In practice it is desirable to supply a set of at least two interchangeable parts in which the intermediate sections 11, 11', 11'' are bent at angles of varying degrees. The interchangeability is preferably provided by means of threaded connections at the ends of the intermediate section, which threaded connections are set at an angle relative to the axis of the intermediate section to ensure that the connecting angle matches the rest of the drill string or the housing section 10.

If the intermediate sections are of the same length they can only differ in their angular setting $\alpha$. This type of set of intermediate sections is advantageous for unchanged use of the shaft which rotates inside the intermediate section 11 to drive the driven shaft 12. Alternatively the set of intermediate sections can differ in length and can be set at their upper and lower ends at a uniform angle $\alpha$, $\beta$ to the upper housing section 9 and the lower housing section 10 respectively. Sets combining both features can also be provided.

The length and deflection angle $\alpha$ of the intermediate section 11 can be fixed and the angle $\beta$ can be selected to suit the desired purpose. The housing section 10 is conveniently also designed as an interchangeable part in order to obtain, by interchange, various angles $\beta$ or, in combination with various deflection angles $\alpha$, various angles $\gamma$. Also various lengths of the housing section 10 adjoining the intermediate section 11 can be employed with the connection to the intermediate section 11, for example, being made by an angularly set thread.

A further possibility of setting the deflection tendency of the drilling tool 2 is to change the distance between the stabilisers 14 and 15 or the distance between the stabiliser 14 and the rotary drill bit 13. Such an arrangement is illustrated in FIG. 14. The first stabiliser 14 is arranged in such a way that it can be adjustably fixed in different positions on the lower housing section 10. This facility, either on its own or in combination with certain preset deflection angles and/or certain preset lengths of the intermediate section 11 or lower housing section 10, enables the deflection tendency to be controlled.

The stabiliser 14 may also be of variable eccentricity so that the bit offset, which changes when the stabiliser 14 is displaced on the lower housing section 10 can be compensated. As the drill bit 13 is moved further away the eccentricity of the stabiliser 14 is increased; two further positions are shown by the dotted lines at 14' and 14''. To make a displacement on the housing section possible, the stabiliser 14 may, for example, be designed as shown and described in FIGS. 9 and 10.

Figure 15:
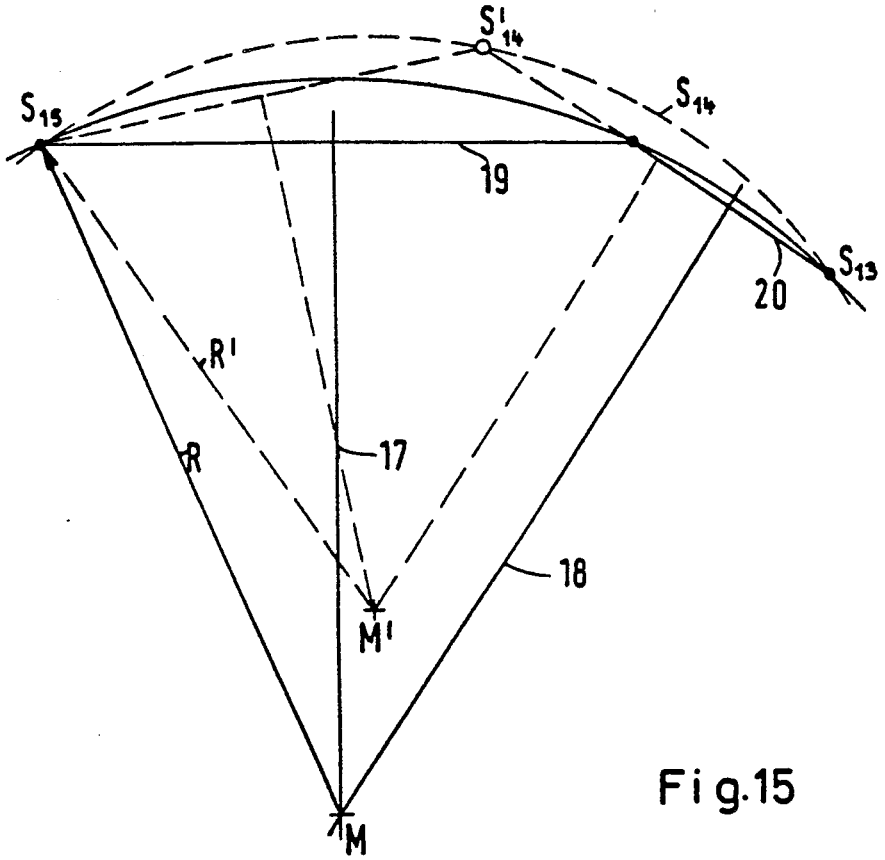
FIG. 15 is a diagram showing the relationship between the radius of curvature of the drill hole profile and the relative positions of the stabiliser and drill bit.

FIG. 15 illustrates the relationship between the arrangement of the stabilisers 14 and 15 and the rotary drill bit 13 and the radius of curvature of the directional drilling. Utilising a drilling device as shown in FIGS. 13 and 14, the intersection points $S_{14}$, $S_{15}$ and $S_{13}$ of the housing axes with the centre transverse planes of the stabilisers 14, 15 and the rotary drill bit 13 respectively are shown in FIG. 14. The center point of the arc of the drill hole profile achieved in this configuration is obtained by the intersection point M of the center verticals 17;18 on the respective connecting lines 19;20 between the intersection points $S_{14}$, $S_{15}$ of the stabilisers 14 and 15 or the intersection points $S_{14}$, $S_{13}$ of the stabiliser 14 and the tool bit 13. The radius of curvature R is then obtained from the distance of the respective intersection points $S_{14}$, $S_{15}$ and $S_{13}$ to the intersection point M of the center verticals. The connecting lines between the intersection points do not have to coincide with the axes of the respective housing sections in every embodiment.

Finally, values are given for a practical embodiment of the drilling tool of FIG. 14. The distance between $S_{14}$ and $S_{15}$ corresponding to the length of line 19 is 8150 mm. The distance between $S_{14}$ and $S_{13}$ corresponding to the length of line 20 is 1155 mm. Angle $\gamma$ of section 11 to the tool main axis 8 is 0.6°. In this configuration, the radius R of 435 m. is obtained. The distance between $S_{14}$ and $S_{13}$ can be increased from 1155 mm. to 1955 mm. (and the distance $S_{14}$ to $S_{15}$ can be reduced) so as to increase the deflection tendency and reduce the radius of curvature R (cf. R', M' and $S'_{14}$ in FIG. 4).

We claim:

1. A downhole assembly for use in an earth drilling operation, said downhole assembly adapted for use in a drilling system in which the downhole assembly is coupled to a drill string and may be selectively rotated, said downhole assembly comprising, a substantially rigid housing assembly, said housing assembly including an upper section and a lower section, each said section having a longitudinal axis, said housing having at least one bend which establishes a predetermined angle of deflection between said upper housing section and said lower housing section;

a downhole motor mounted in said housing assembly, said downhole motor mounted at least partially in said upper housing section, said downhole motor having an output shaft;

a drill bit coupled to said output shaft of said downhole motor, said drill bit having a longitudinal axis;

a first concentric stabilizer coupled to said housing assembly, said first stabilizer being generally aligned with said longitudinal axis of said drill bit; and a second concentric stabilizer mounted to the upper section of said housing assembly, said second concentric stabilizer being axially aligned with said drill string, said downhole assembly having no additional stabilizers located intermediate said first and second concentric stabilizers.

2. A downhole assembly for use in an earth drilling operation, said downhole assembly adapted for use in a drilling system in which the downhole assembly is coupled to a drill string, and in which the drill string may be selectively rotated, said drilling system being adapted for generally straight drilling when said drill string is rotated, and said drilling system being adapted to drill generally curved boreholes when only said downhole assembly is operated, said downhole assembly comprising, a substantially rigid housing assembly, said housing assembly including an upper section and a lower section, said upper section including a longitudinal axis and said lower section including a longitudinal axis, said lower section of said housing assembly being disposed at a predetermined angle relative to said upper section when said downhole assembly is utilized;

a downhole motor located in said housing assembly, said downhole motor located at least partially in said upper section;

a drill bit operatively coupled to said downhole motor for being rotated thereby, said drill bit having a longitudinal axis; and a stabilizer group, said stabilizer group consisting essentially of concentric stabilizers, said stabilizer group comprising at least two concentric stabilizers, a first concentric stabilizer located above said drill bit and concentric with said axis of said lower housing section, and a second concentric stabilizer mounted to the upper section of said housing assembly and oriented coaxially with said drill string.

* * * * *